US011140982B2

(12) United States Patent
Sunstrom et al.

(10) Patent No.: US 11,140,982 B2
(45) Date of Patent: Oct. 12, 2021

(54) DESK SUPPORT WITH STOOL

(71) Applicant: School Specialty, Inc., Greenville, WI (US)

(72) Inventors: Adam Sunstrom, Appleton, WI (US); Ryan Haase, Temple, TX (US)

(73) Assignee: School Specialty, LLC, Greenville, WI (US)

( * ) Notice: Subject to any disclaimer, the term of this patent is extended or adjusted under 35 U.S.C. 154(b) by 0 days.

(21) Appl. No.: 16/731,682

(22) Filed: Dec. 31, 2019

(65) Prior Publication Data

US 2021/0196042 A1 Jul. 1, 2021

(51) Int. Cl.

| | |
|---|---|
| ***A47B 83/02*** | (2006.01) |
| ***A47C 3/026*** | (2006.01) |
| ***A47C 3/029*** | (2006.01) |
| ***A47C 7/68*** | (2006.01) |
| ***A47B 39/02*** | (2006.01) |
| ***A47C 3/30*** | (2006.01) |
| ***A47C 3/40*** | (2006.01) |
| ***A47C 3/02*** | (2006.01) |
| ***A47B 83/00*** | (2006.01) |

(52) U.S. Cl.

CPC ..... *A47B 83/02* (2013.01); *A47B 39/02* (2013.01); *A47B 83/008* (2013.01); *A47C 3/02* (2013.01); *A47C 3/026* (2013.01); *A47C 3/029* (2013.01); *A47C 3/30* (2013.01); *A47C 3/40* (2013.01); *A47C 7/68* (2013.01); *A47B 2083/025* (2013.01)

(58) Field of Classification Search

CPC ..... A47B 83/02; A47B 83/008; A47B 39/02; A47B 2083/025; A47B 2021/0307; A47B 21/0371; A47C 3/026; A47C 3/029; A47C 3/30; A47C 3/40; A47C 7/68; A47C 3/02

USPC ..... 297/135, 156, 161, 174 R, 183.1, 183.5, 297/271.5; 108/43, 50.1; 248/118.1, 248/918; D6/406.4

See application file for complete search history.

(56) References Cited

U.S. PATENT DOCUMENTS 120,234 A * 10/1871 Bligh ..... A47B 39/02 297/174 R
134,668 A * 1/1873 Henrichs ..... A47D 1/08 297/131

(Continued)

FOREIGN PATENT DOCUMENTS

CA 2292617 A1 * 12/1998 ..... A47B 83/02
DE 9409583 U1 * 10/1994 ..... B41J 29/00
GB 1420164 A * 1/1976 ..... A47C 3/30

*Primary Examiner* — Robert Canfield
(74) *Attorney, Agent, or Firm* — Nicholas A. Kees; Godfrey & Kahn, S.C.

(57) ABSTRACT

A stool and desk support system. The system includes a stool base and a desk support surface. A support member may connect the desk support surface to the stool base and support the desk support surface above a floor surface. The stool base may include a stool seat surface and a rocking mechanism opposite the stool seat surface. The desk support surface may be connected to a desk support base by a neck extending from the desk support base. The stool base may include an upper stool base frame and a lower stool base frame. The upper stool base frame may be height adjustable with respect to the lower stool base frame. The desk support base may connect to the upper stool base frame, permitting coinciding height adjustment of the desk support surface and the upper stool base frame.

5 Claims, 13 Drawing Sheets

(56) References Cited

U.S. PATENT DOCUMENTS 138,620 A * 5/1873 Downing ..... B62B 1/18 280/43.24
213,504 A * 3/1879 Galt et al. ..... A47D 1/10 297/130
736,709 A * 8/1903 Dutton ..... A47C 1/035 297/81
1,023,620 A * 4/1912 Burge ..... A47C 3/026 248/596
D145,659 S * 10/1946 Covington ..... D6/340
2,488,222 A * 11/1949 Morgan ..... A47C 9/022 312/235.9
2,702,584 A * 2/1955 Williams ..... A47C 7/42 297/124
2,979,117 A * 4/1961 Barecki ..... A47B 39/04 297/170
3,380,778 A * 4/1968 Barecki ..... A47C 7/68 297/451.1
3,874,725 A * 4/1975 Perry ..... A47D 13/102 297/133
4,995,668 A 2/1991 Zivari
D315,463 S * 3/1991 Spiegel ..... D12/133
5,072,905 A * 12/1991 Hyatt ..... A47B 21/0371 248/118
5,078,351 A * 1/1992 Gualtieri ..... A47C 3/30 188/300
5,147,090 A * 9/1992 Mandell ..... A47B 21/0371 248/118.1
5,383,632 A * 1/1995 Shirlin ..... A47B 21/0371 248/118.5
5,490,466 A * 2/1996 Diffrient ..... A47B 21/0314 108/96
5,511,851 A 4/1996 Zivari
5,692,815 A * 12/1997 Murphy ..... G06F 3/0395 312/283
5,931,103 A * 8/1999 Huang ..... A47B 21/00 108/50.02
6,170,405 B1 * 1/2001 Weitzman ..... A47B 3/083 108/174
6,454,224 B1 * 9/2002 Nogueira ..... A47B 21/0371 248/118
7,625,047 B2 12/2009 Bertele
8,136,876 B2 * 3/2012 Bellvis Castillo ..... A47C 9/025 297/195.11
8,297,706 B2 10/2012 Matthews
8,316,777 B1 * 11/2012 Rosing ..... A47B 23/046 108/49
8,371,237 B2 * 2/2013 Weber ..... A47B 21/0314 108/97
8,998,319 B2 * 4/2015 Bahneman ..... A47C 9/002 297/270.5
9,003,979 B2 * 4/2015 Bahnof ..... B62B 3/00 108/50.14
9,516,947 B2 12/2016 Taylor
9,538,839 B2 1/2017 Favaro
D778,653 S * 2/2017 Spoelhof ..... D6/707.22
D801,714 S * 11/2017 Elmaleh ..... D6/352
D835,626 S 12/2018 Mir
10,306,996 B1 6/2019 Sima
10,368,638 B2 8/2019 Hui
10,376,071 B2 * 8/2019 Patton ..... F16C 11/04
10,578,389 B2 * 3/2020 Kinney ..... F41A 23/16
10,681,989 B2 * 6/2020 Marsh ..... A47C 1/14
10,695,900 B2 * 6/2020 Robert ..... B25H 1/16
D905,455 S 12/2020 Fletcher et al.
2003/0164633 A1 * 9/2003 Jakus ..... A47C 9/002 297/271.5
2006/0174807 A1 * 8/2006 Dral ..... A47B 21/0073 108/50.01
2007/0138850 A1 * 6/2007 Oettinger ..... A47C 9/002 297/271.5
2009/0001788 A1 * 1/2009 Lenz ..... A47C 9/002 297/217.4
2012/0267923 A1 * 10/2012 Bouche ..... A47C 7/626 297/161
2013/0320727 A1 * 12/2013 Martin ..... A47C 3/16 297/270.1
2016/0302571 A1 * 10/2016 McBride ..... A47C 9/022
2018/0228279 A1 * 8/2018 Guzman ..... A47B 9/14
2020/0383473 A1 * 12/2020 Fletcher ..... A47B 83/02

* cited by examiner

DESK SUPPORT WITH STOOL

FIELD OF THE INVENTION

The present disclosure relates generally to stools and desk supports, and in particular, to an assembly combining a stool with a desk support.

BACKGROUND

With respect to classroom desks, a typical desk and stool setup consists of a desk, having a desk surface and a plurality of legs extending from the desk surface to a floor surface, and a separate stool that is slidable underneath the desk, such that a person sitting on the stool may extend his or her legs between the legs of the desk. With such setups, any substantial movement requires separate steps to move each desk and each stool, and the two pieces may be heavy or awkward to grab and move across the floor surface, for instance, when there is need to store the desks and stools or if rearrangement of the same is desired. For example, in many classroom settings, it is desirable to create new classroom seating arrangements at different times of the academic year. Even within the span of a single class, it may be desirable to rearrange the desks into small group clusters and then return the classroom to its standard seating configuration by the end of the session. Further, when using a standard desk and stool combination, the user's legs are confined by the legs of the desk and may bump into such legs, particularly if the user is a child who may fidget or if the stool is a stool that permits rocking movement and movement of one or more limbs is required to rock the stool. Further still, a user with longer legs may face the problem of bumping his or her knees into the desk support when raising the height of a height-adjustable stool for optimal leg fit and comfort.

As such, there is a need for a lightweight desk and stool system that may be easily gripped and maneuvered to a new location and that may allow for more unrestrained leg movement, particularly when rocking on a stool. Further still, there is a need for a desk support that elevates when the seat portion of a height-adjustable stool elevates.

This invention relates to improvements to some of the apparatus described above, and to solutions to some of the problems raised or not solved thereby.

SUMMARY OF INVENTION

A certain aspect of the present invention provides a system for combining a desk with a seating device. In this aspect, the system is configured to combine a desk support with a stool. Accordingly, in one embodiment, the present invention provides a stool and desk support system. The system includes a stool base and a desk support surface that is spaced apart from the stool base. The desk support surface is connected to the stool base and supported above a floor surface by a support member.

Another aspect of the invention again provides a stool base and a desk support. The stool base has a stool seat surface and a rocking mechanism opposite the stool seat surface. The desk support includes a desk support base connected to the stool base, a neck that extends from the desk support base, and a desk support surface connected to the neck at a position spaced apart from the desk support base.

A further aspect of the invention provides a system having a stool base, a desk support, a weight, and a seat. The stool base includes a rocker portion with an interior rocker frame and an exterior, convex rocker surface secured to the rocker frame. The rocker surface is configured to rest against a floor surface and permit rocking of the system with respect to the floor surface. The stool base further includes a stool base frame having a lower stool base frame secured to the rocker portion and an upper stool base frame telescoping at least in part with the lower stool base frame. Finally, the stool base includes a pneumatic cylinder positioned within the stool base frame and a control mechanism positioned proximate to the pneumatic cylinder such that substantial depression of the control mechanism activates the pneumatic cylinder.

The desk support includes a desk support base. The desk support base is secured to the upper stool base frame. The desk support further includes a neck that extends in a generally upward direction from the desk support base and a desk support surface that extends in a generally horizontal direction from the neck. The desk support surface is positioned along the neck at a location spaced apart from the desk support base. Finally, the desk support includes structural ribbing extending along at least a portion of the neck to at least a portion of an underside of the desk support. The weight is secured to the desk support base and is of a size and weight to, at least in part, offset the weight of the neck and desk support surface. Lastly, the seat includes a seat core that is secured to the desk support base and a textured cover that is positioned over the seat core.

Yet another aspect of the invention provides a desk adaptation for a stool having a stool base. The desk adaptation includes a desk support base configured to connect to the stool base, a neck that connects to and extends from the desk support base, and a desk support surface that connects to the neck and is spaced apart from the desk support base.

Other objects and advantages of the present disclosure will become apparent hereinafter.

DETAILED DESCRIPTION

Figure 1:
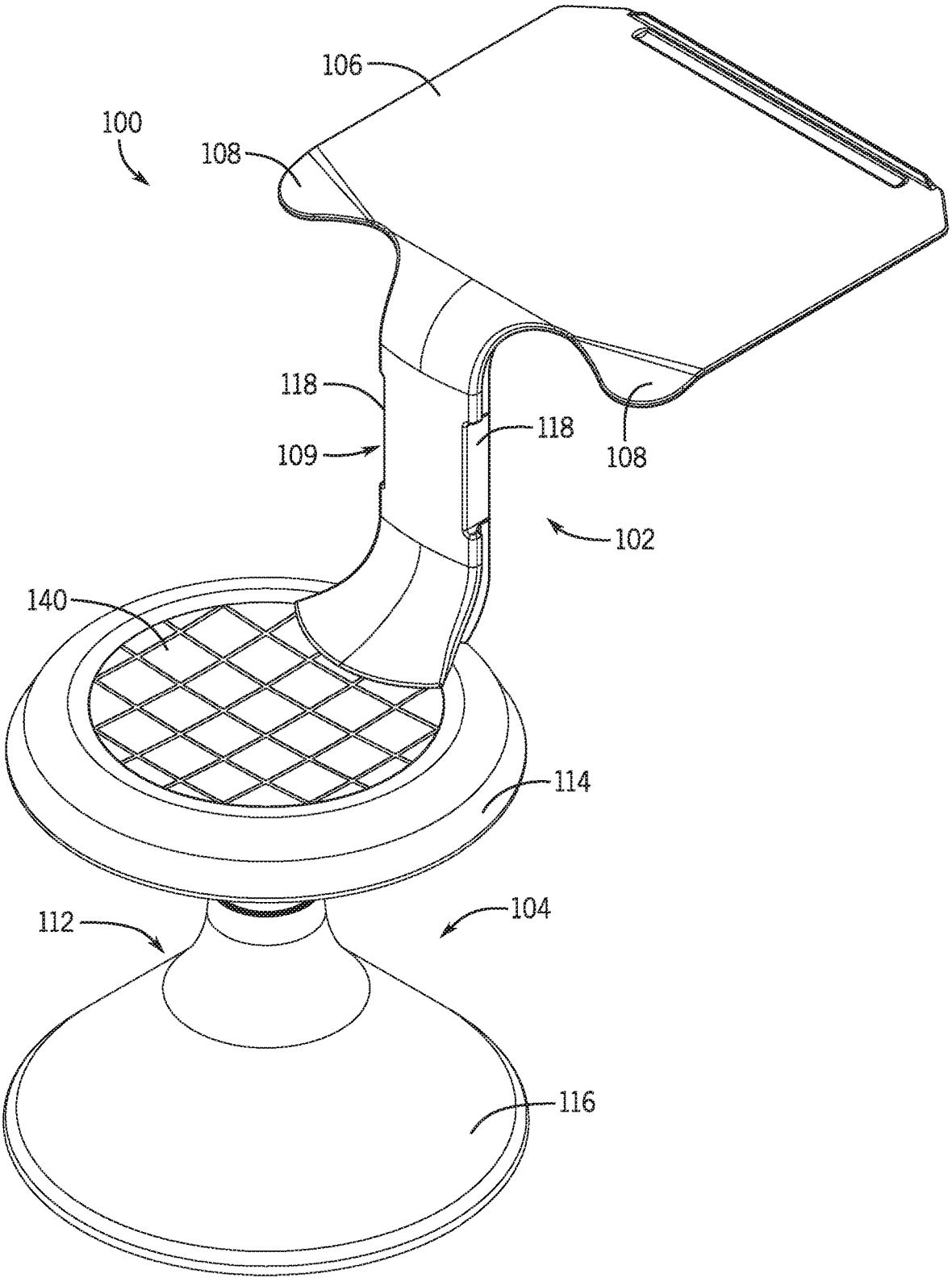
FIG. 1 is a top perspective view of a desk support with stool, according to one embodiment of the present disclosure.

Referring to FIGS. 1-8, multiple views are shown of a stool and desk support system 100, according to one embodiment of the present disclosure. In this embodiment, the stool includes a desk support 102 and a stool base 104.

The desk support 102 may include a desk support surface 106 to support a user's notebook or laptop for use while the user sits on the stool base 104. Although the desk support surface 106 shown is generally horizontal when the system 100 is positioned upright, in other embodiments, the desk support surface may be aligned at an alternative angle that is sufficient to permit writing or typing during use. In some embodiments, portions of the desk support surface 106 near the user may be angled downward to create rests 108 to increase the user's hand and/or wrist comfort. The desk support 102 may further include one or more support members 109, extending between the desk support surface 106 and the stool base 104. While in this embodiment, the support member 109 is shown as a unitary neck member, in other embodiments, additional members may likewise be used to support the desk support surface 106 and connect the desk support surface 106 to the stool base 104. Additionally, the support member 109 may be unitarily formed with the desk support surface 106 or may be separate elements connected during assembly. Forming the connection between the stool base 104 and the desk support surface 106 using a single or concentrated number of support members allows for a comfortable seating experience without the concern of a user bumping his or her knees against the legs or sides that may accompany a more standard desk. Additionally, with respect to a stool and desk system that includes a rocking stool, the absence of legs or other support members that contact the floor surface increases the ease of rocking the system.

Figure 2:
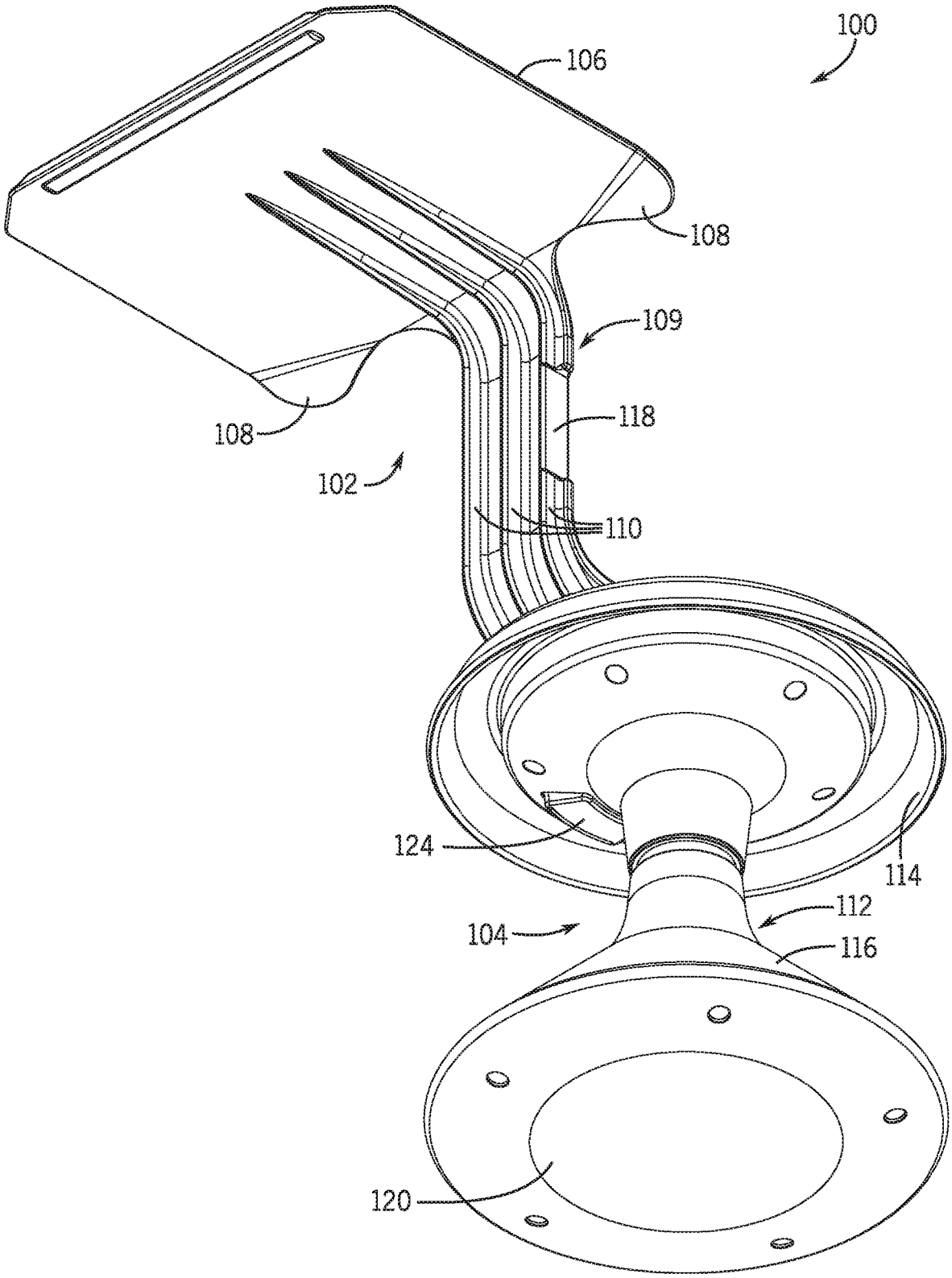
FIG. 2 is a bottom perspective view of the desk support with stool of FIG. 1.
Figure 3:
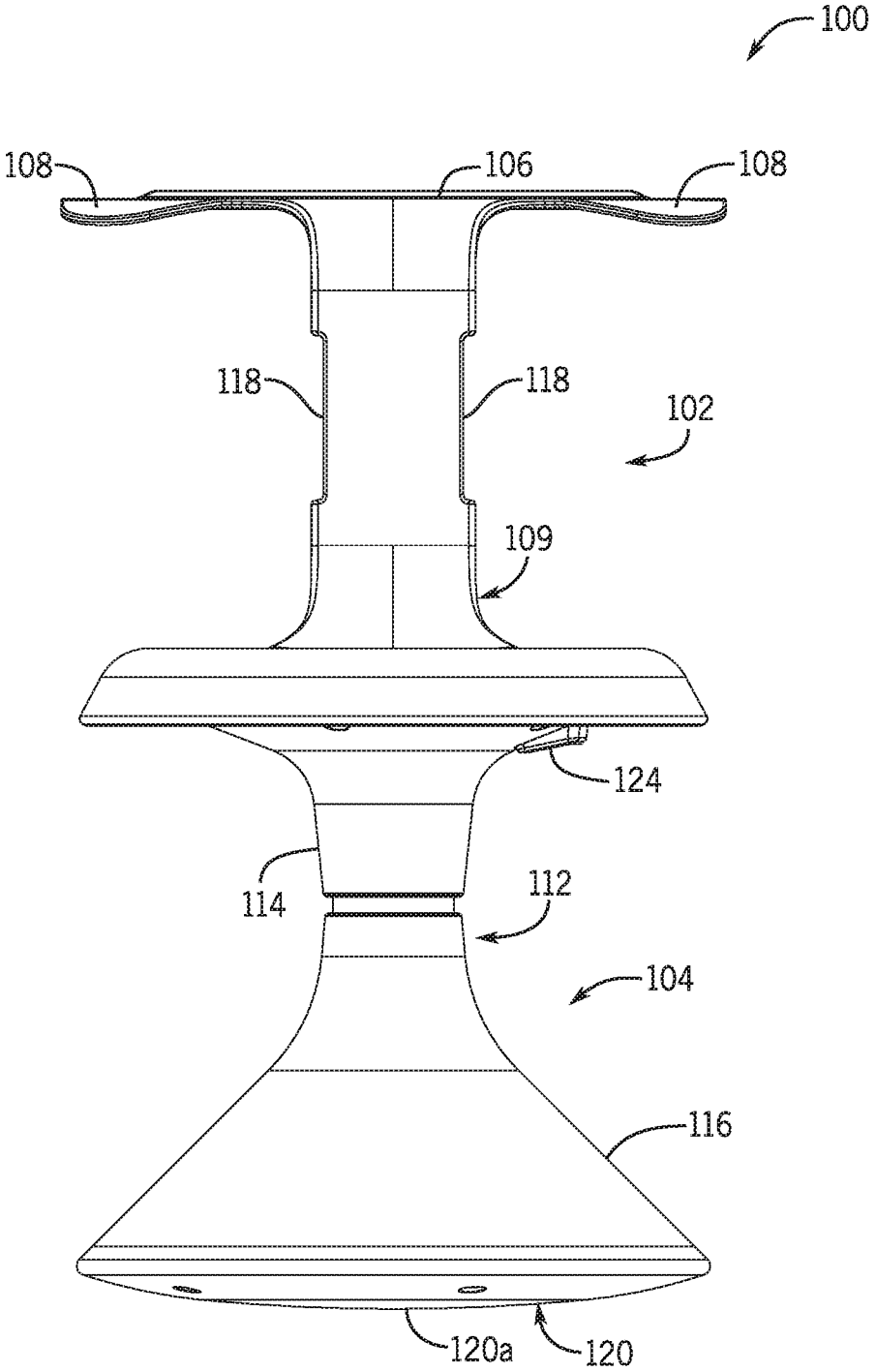
FIG. 3 is rear view of the desk support with stool of FIG. 1.
Figure 4:
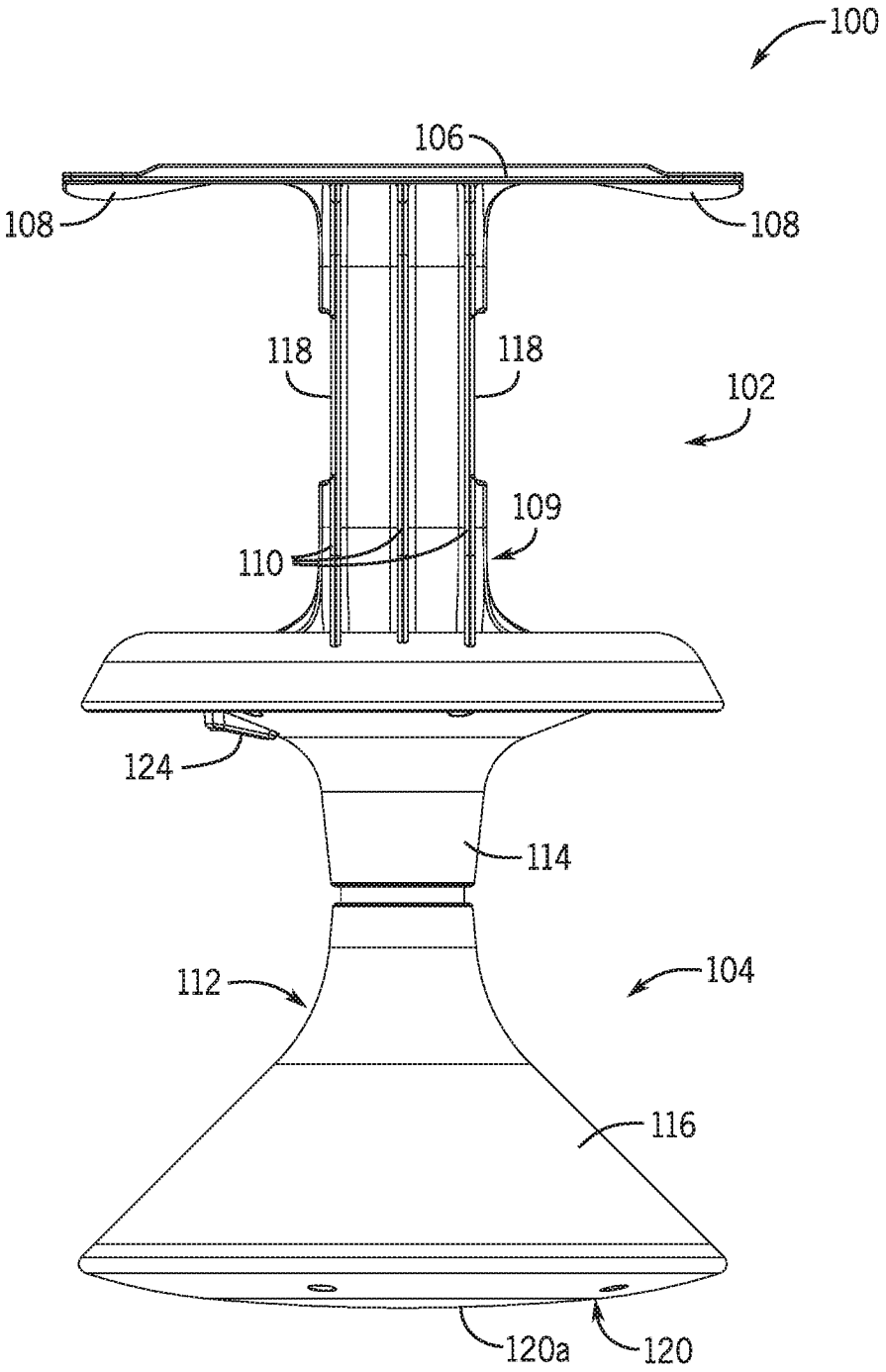
FIG. 4 is a front view of the desk support with stool of FIG. 1.
Figure 5:
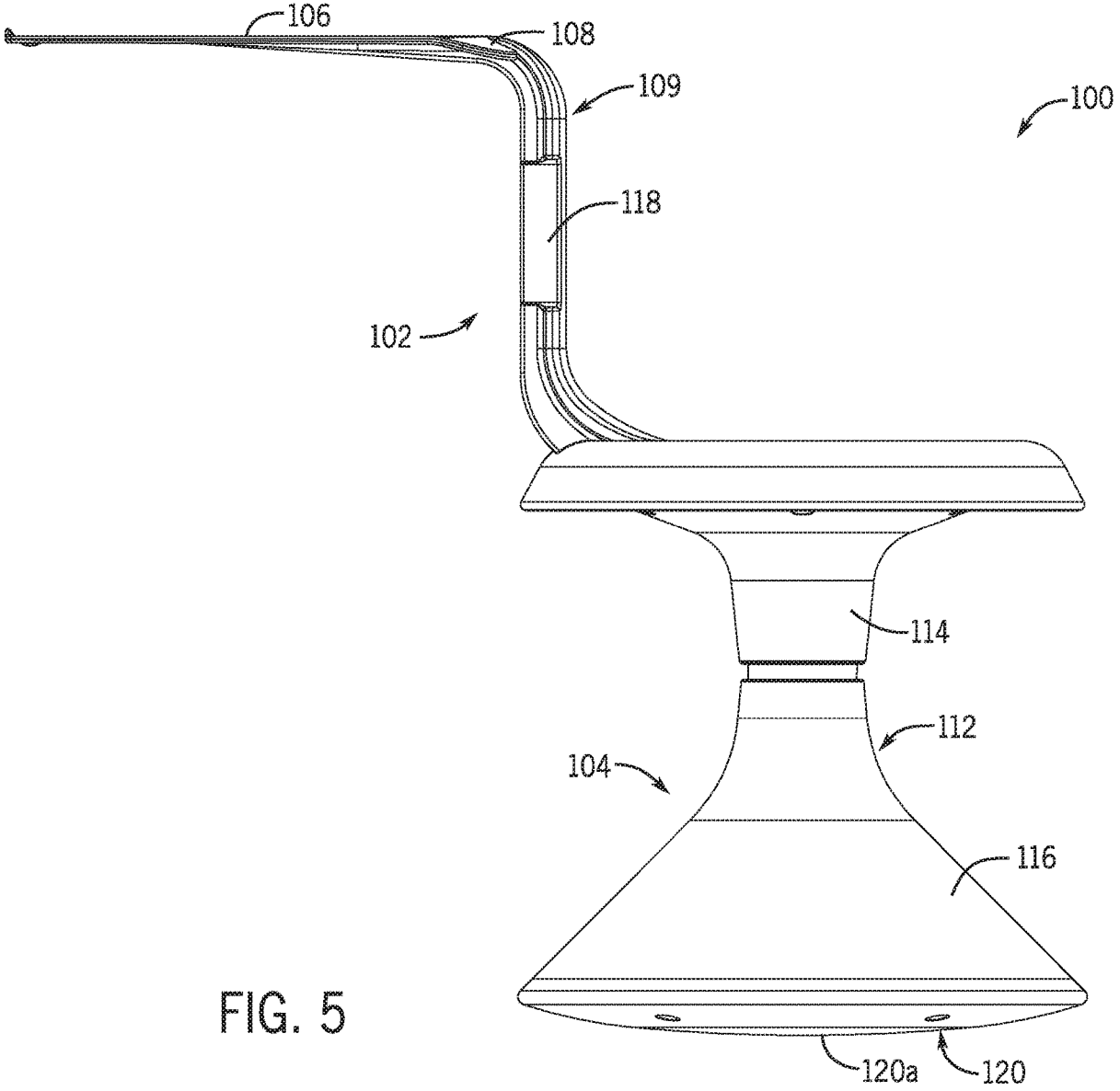
FIG. 5 is a left side view of the desk support with stool of FIG. 1.
Figure 6:
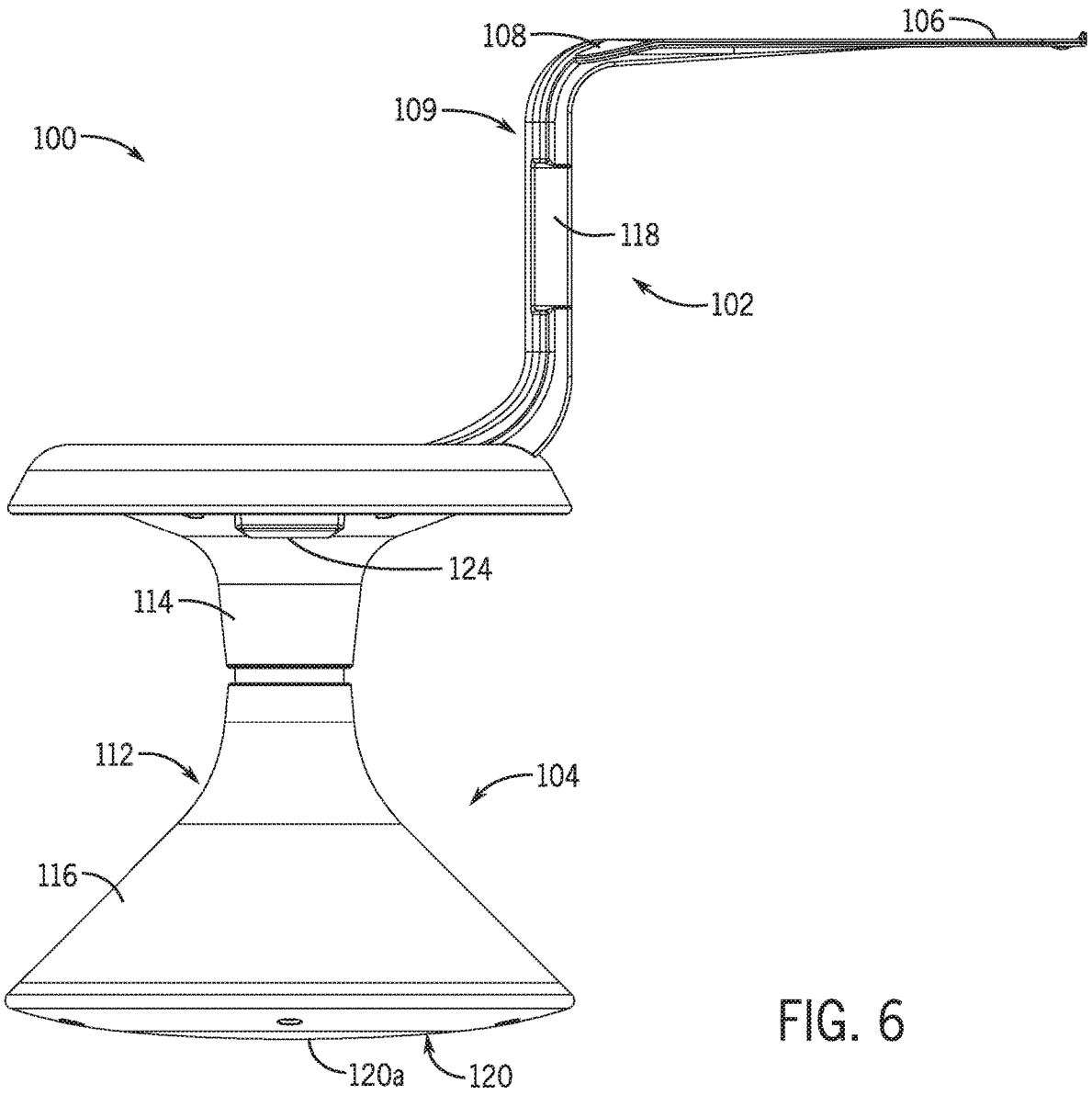
FIG. 6 is a right side view of the desk support with stool of FIG. 1.
Figure 7:
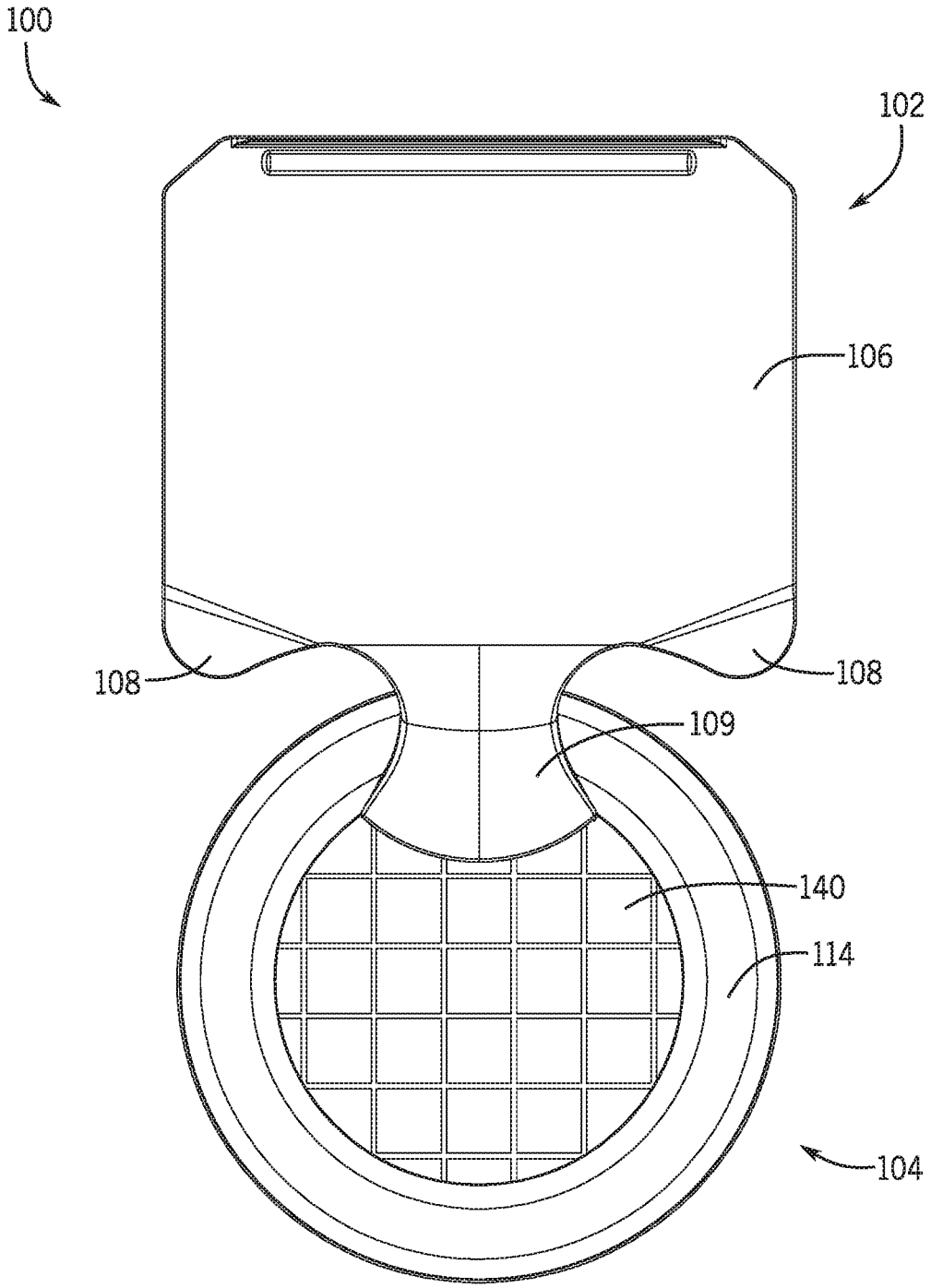
FIG. 7 is a top plan view of the desk support with stool of FIG. 1.
Figure 8:
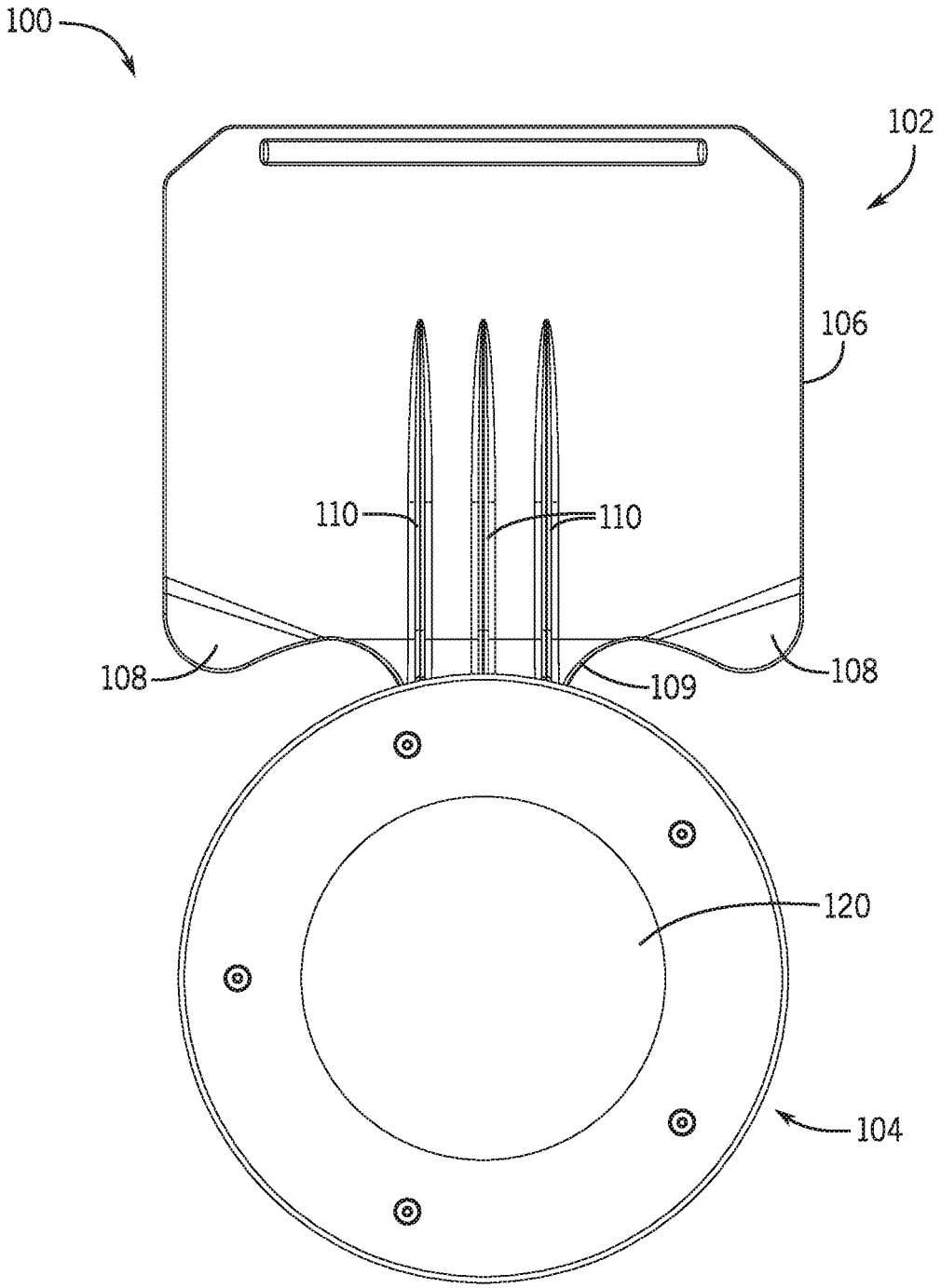
FIG. 8 is a bottom plan view of the desk support with stool of FIG. 1.
Figure 12:
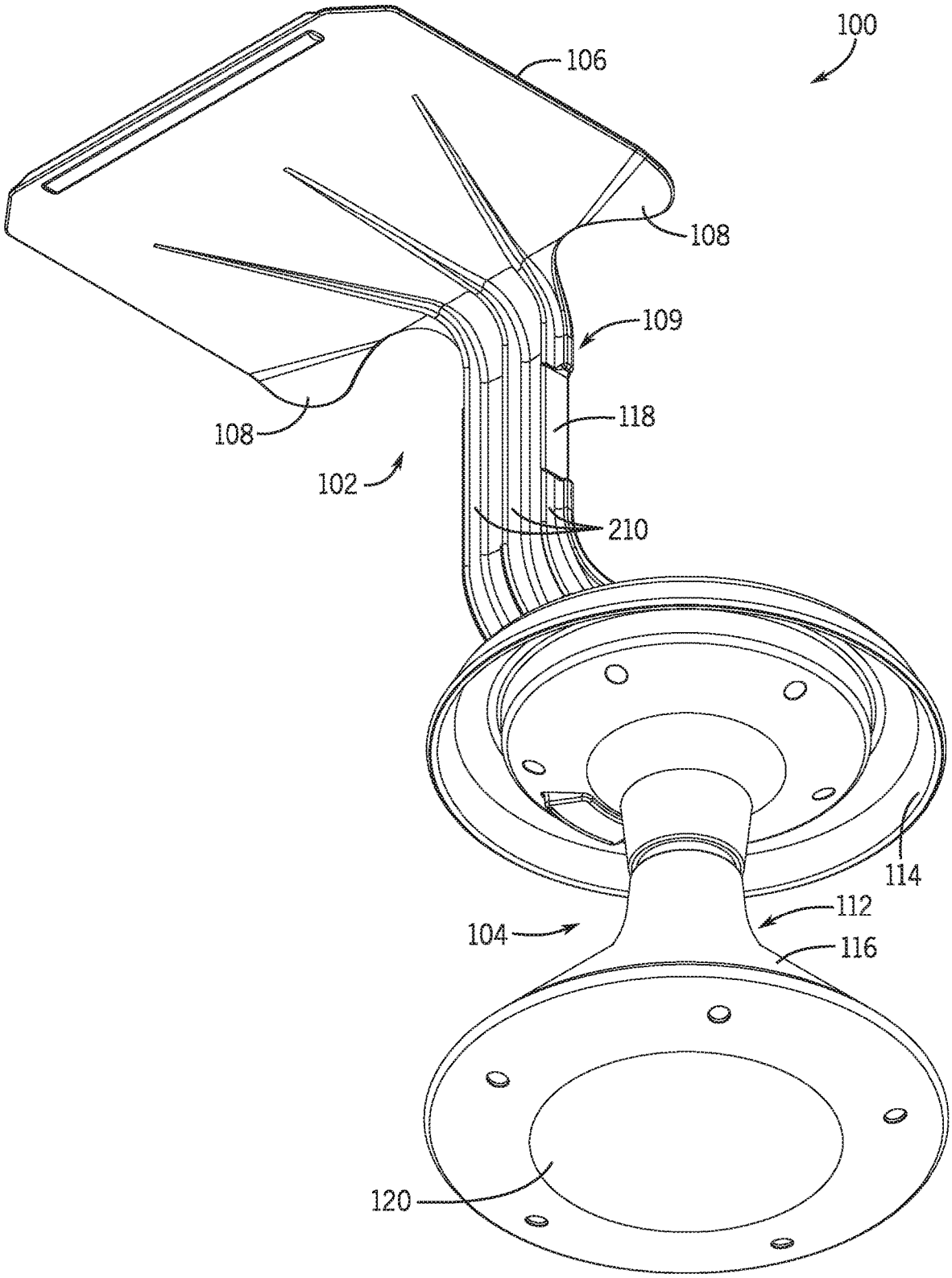
FIG. 12 is a bottom perspective view of a desk support with stool, according to another embodiment of the present disclosure.
Figure 13:
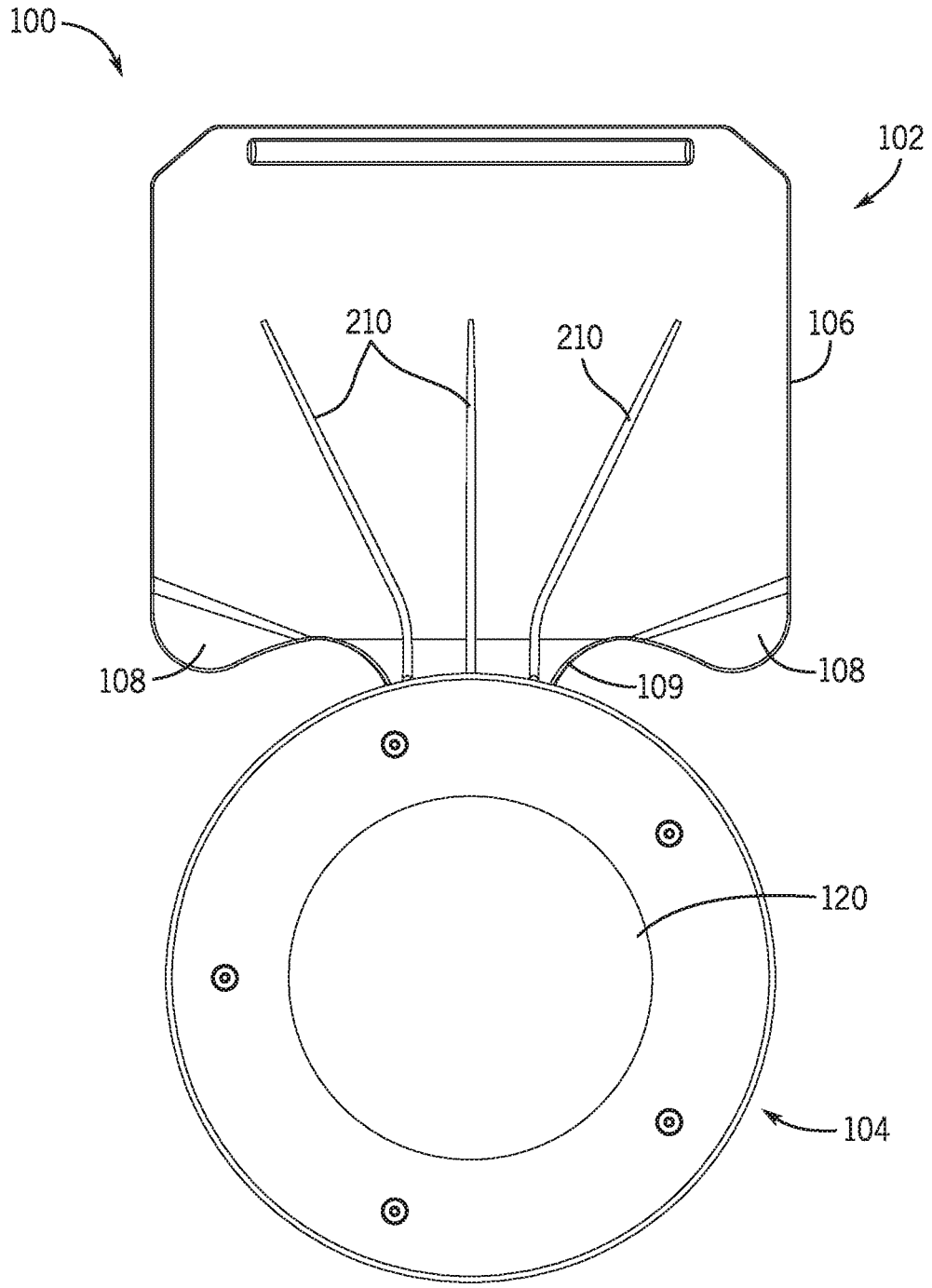
FIG. 13 is a bottom plan view of the desk support with stool of FIG. 12.

Referring to FIGS. 2 and 8, in some embodiments, structural ribbing 110 may be formed along the support member 109 and may further extend from the support member 109 to the underside of the desk support surface 106. The structural ribbing 110 provides additional structural support to the desk support 102, particularly when the system 100 is in use and the weight of textbooks, notebooks, laptops, etc. are added to the desk support surface 106. In the embodiment shown in FIGS. 2 and 8, structural ribbing 110 includes 3 ribs that extend generally parallel to one another as the ribbing 110 extends underneath the desk support surface 106. Alternatively, a different number of ribs may be utilized and such ribs may extend in different directions depending on the support needs of a given system 100. For instance, FIGS. 12-13 show structural ribbing 210 arranged in an alternate pattern. In this embodiment, ribbing 210 still includes 3 ribs, although the ribs diverge as ribbing 210 extends underneath the desk support surface 106 to further disperse the support provided by ribbing 210. This ribbing pattern provides additional strength support to systems 100 that may encounter heavier loads, for instance heavier laptops or textbooks.

Further, on one or more sides of the support member 109, one or more gripping portions may be included. In this embodiment, the gripping portions are shown as indented portions 118, positioned on opposing sides of the support member 109. However, in other embodiments, other forms of gripping elements and/or mechanisms may be employed. The increased ease of gripping the support member 109 via gripping elements, such as indented portions 118, further increases to the mobility of the entire system 100 by a single individual for purposes such as storage or classroom restructuring.

Referring now to the stool base 104, the stool base 104 may include a stool frame 112. In some embodiments, the stool frame 112 may include an upper stool base frame 114 and a lower stool base frame 116. Such composition may be particularly useful when height adjustment is a desirable feature of the stool base 104. In other embodiments, the stool frame 112 may be a single unitary element or may further include additional frame elements. The portion of the stool frame 112 that is designed to, at least in part, contact the floor surface may include a rocking mechanism 120 that permits the system 100 to rock with respect to the floor surface. Alternatively, the bottom of stool frame 112 may be flat or concave, encouraging stationary use of the system 100.

Figure 9:
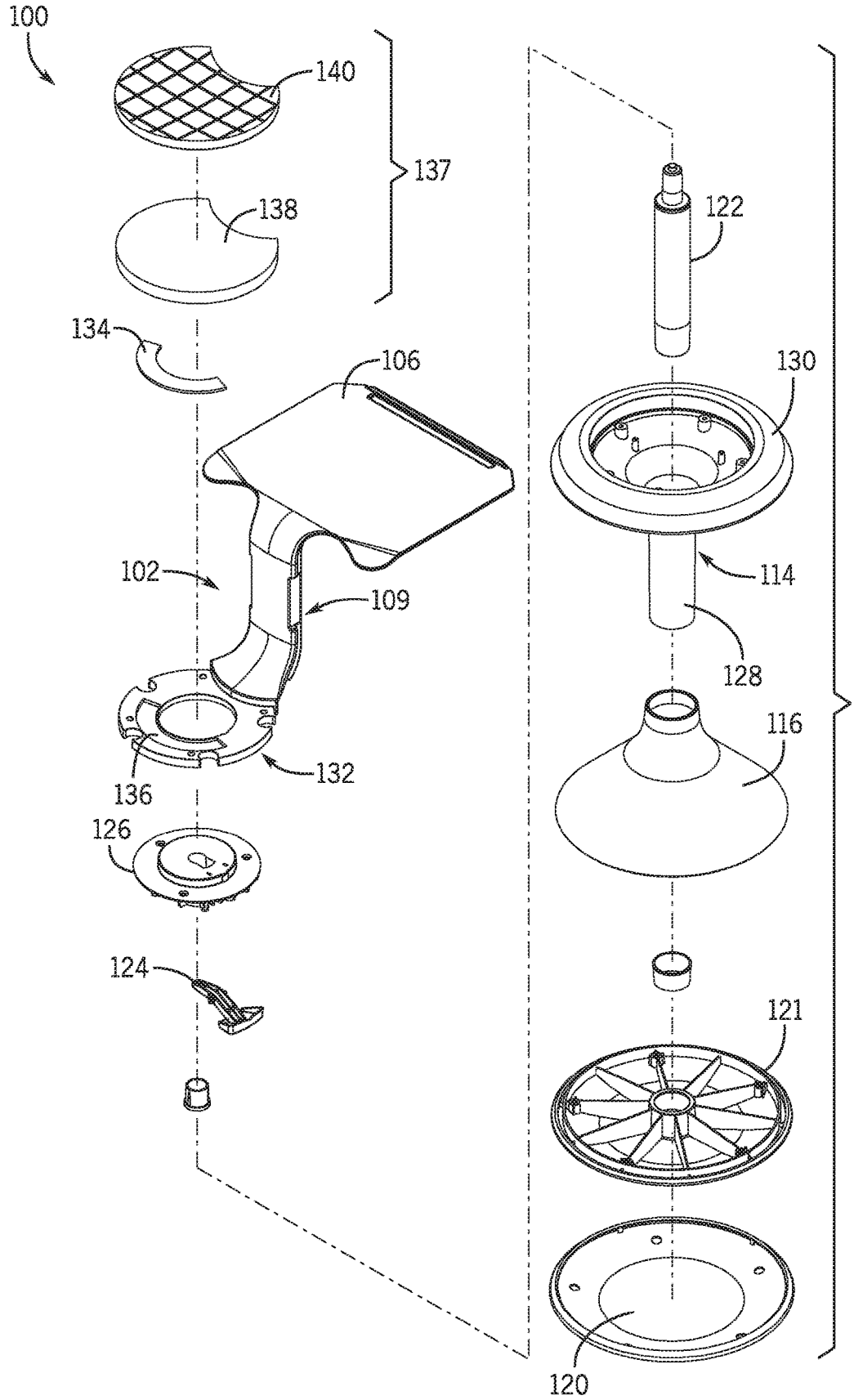
FIG. 9 is an exploded perspective view of the deck support with stool of FIG. 1.
Figure 10:
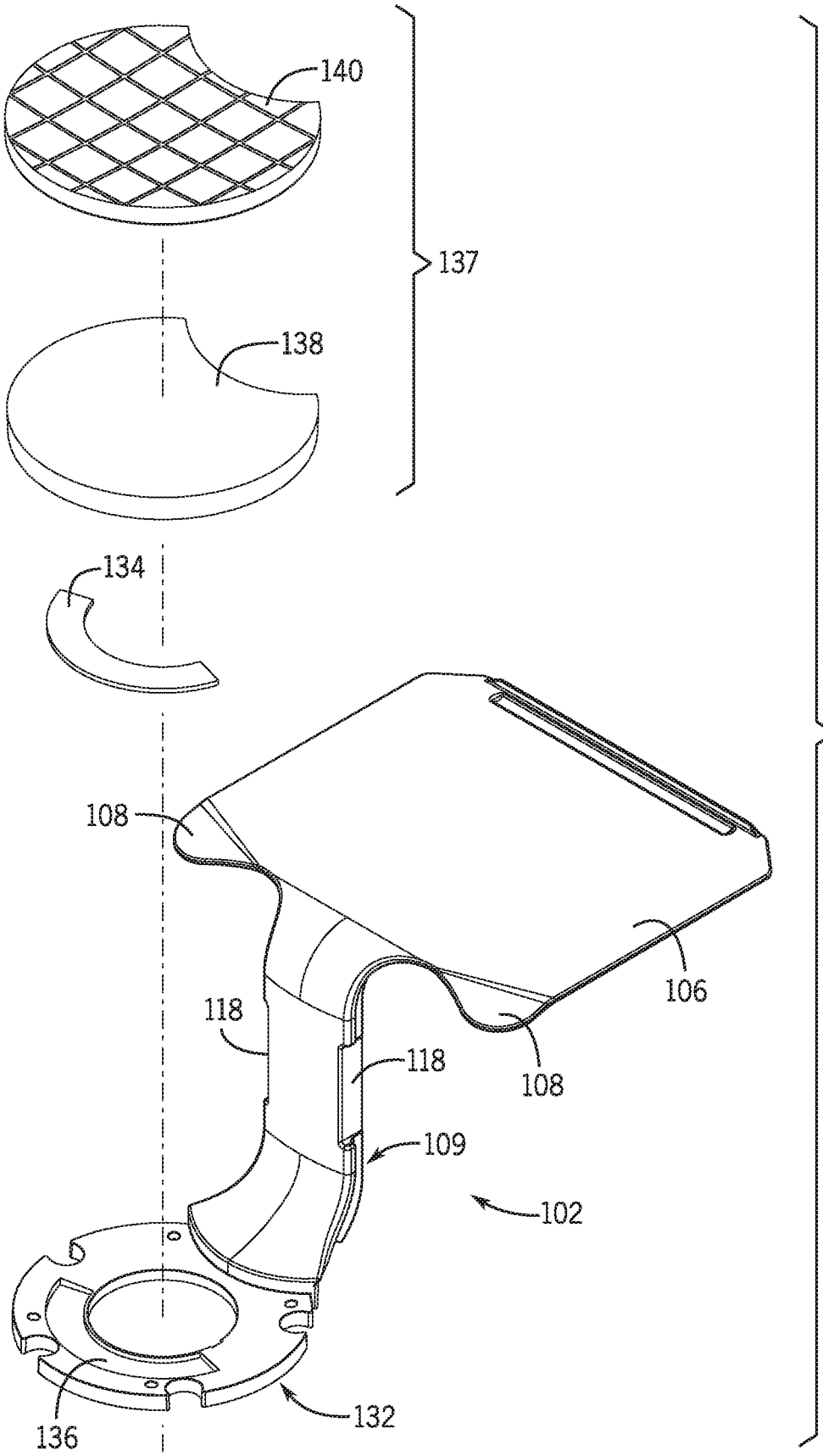
FIG. 10 is an enlarged exploded view of the desk support and stool seat shown in FIG. 9.

Referring to FIG. 9, the rocking mechanism 120 may include a convex rocker surface **120*a* secured to the stool base 104. Alternatively, a surface of the stool base 104 itself may be formed in a convex shape that permits rocking of the system 100 with respect to the floor surface. Alternatively still, other shapes or structures that permit rocking of the system with respect to the floor surface may be attached to or formed into the stool base 104. In the embodiment shown in FIG. 9, a rocker frame 121 is secured to the interior of the rocking mechanism 120 and to the lower stool base frame 116**. Here, screws are used as the means of securement, although other securement means may be utilized in other embodiments.

In the present embodiment, the stool base 104 shown is height adjustable. The height adjustments are achieved through a standard pneumatic cylinder configuration, as will be understood by a person having reasonable skill in the art of height adjustable seating. Briefly, a pneumatic cylinder 122 is utilized in conjunction with a control mechanism 124, such as a push button, to raise or lower the upper stool base frame 114 with respect to the lower stool base frame 116. When assembled, the control mechanism 124 nests within a control panel 126, in a position accessible to the user of the system 100. The upper stool base frame 114 may include an elongated portion 128 and a widened portion 130. When the system 100 is assembled, the elongated portion 128 telescopes at least in part with the lower stool base frame 116, which secures the elongated portion 128 laterally while permitting the elongated portion 128, and thus the upper stool base frame 114 as a whole, to slide in a generally vertical direction with respect to the stool base frame 116.

Referring now to the desk support 102, FIG. 9 further shows that the desk support 102 may include a desk support base 132 as the means for securing the desk support 102 to the stool base 104. The desk support base 132 may be unitarily formed with the support member 109, as shown in the present embodiment, or may form a separate element that is attached to the support member 109 at the time of assembly. In the embodiment shown, the desk support base 132 is screwed to the widened portion 130 of the upper stool base frame 114, although other means of securement are permissible. By securing the desk support 102 to the upper stool base frame 114, height adjustments to the upper stool base frame 114 proportionally adjust the height of the desk support surface 106. Thus, for example, during raising of the upper stool base frame 114 to accommodate for longer legs, the user's knees may avoid being raised into closer, more cramped proximity of the desk support surface 106 or directly into the underside of the desk support surface 106.

In some embodiments, a weight 134 may be secured to the desk support base 132. The weight 134 may be sized and weighted to, at least in part, offset or counterbalance the weight of the support member 109 and desk support surface 106. In the present embodiment, an indented portion 136 of a given shape is formed in the desk support base 132, and the weight 134 is sized to fit within the shape of the indented portion 136. In this embodiment, the weight is formed of steel, but other materials sufficient to counterbalance the weight of the support member 109 and desk support 106 may be used in other embodiments.

Figure 11:
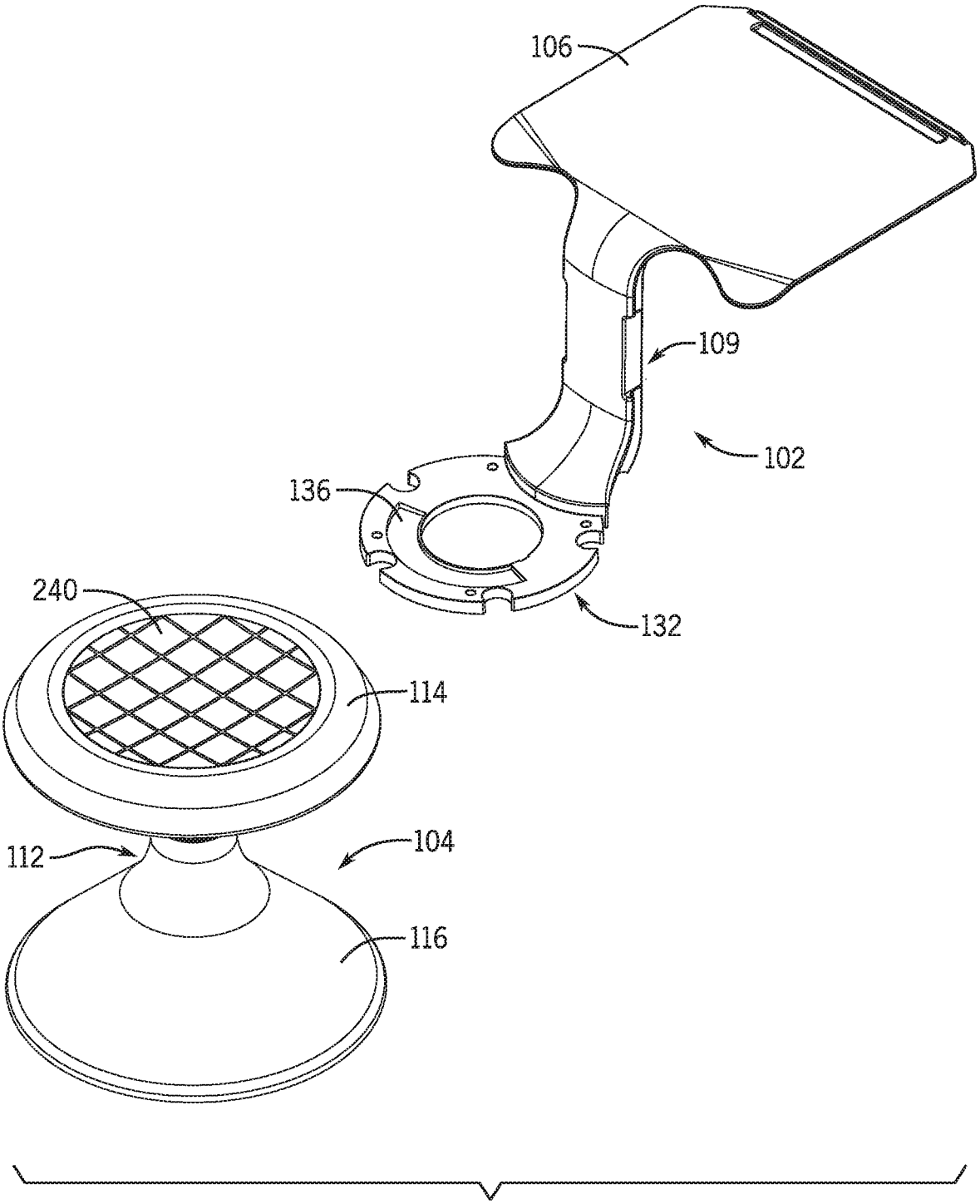
FIG. 11 is a top perspective view of the desk support of FIG. 10, and a stool similar to the stool of FIG. 10, but bearing an alternate stool seat.

Finally, a stool seat 137 may be connected to the stool base 104. The stool seat 137 may include a seat core 138 that may connect to the stool base 104 through attachment to the desk support base 132. In the present embodiment, the seat core 138 is screwed to the desk support base 132. Additionally, a seat cover 140 may be positioned over the seat core 138. The seat cover 140 may improve aesthetics by adding a pattern or color to a potentially flat and/or colorless seat core 138. The seat cover 140 may also be textured to add traction to the seat, as shown with respect to seat cover 140 in FIG. 9. This may help prevent students from sliding on the seat, particularly in embodiments that utilize rocking stool bases 104. In the present embodiment, seat cover 140 and seat core 138 are shaped to allow for the extension of the support member 109 from the seat base 104. In some instances, removal of the desk support 102 may be desired, so that the stool base 104 may function as a stool without a desk support component. In such embodiments, the desk support 102, along with the seat cover 140, the seat core 138, and the weight 134 may be disconnected from the stool base 104, and may be replaced by a respective seat cover and seat core shaped differently to account for the absence of the support member 109. The general shape of the replacement components may be seen in FIG. 11, with reference to the alternate seat cover 240, positioned on the stool base 104.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A stool and desk support system comprising:

a stool base comprising:

a rocker portion having an interior rocker frame and an exterior, convex rocker surface secured to the rocker frame, the rocker surface configured to, at least in part, contact a floor surface and permit rocking of the system with respect to the floor surface;

a stool base frame having a lower stool base frame secured to the rocker portion and an upper stool base frame telescoping at least in part with the lower stool base frame;

a pneumatic cylinder positioned within the stool base frame; and a control mechanism positioned proximate to the pneumatic cylinder such that substantial depression of the control mechanism activates the pneumatic cylinder;

a desk support comprising:

a desk support base secured to the upper stool base frame;

a neck extending in a generally upward direction from the desk support base;

a desk support surface extending in a generally horizontal direction from the neck at a position along the neck spaced apart from the desk support base; and structural ribbing extending along at least a portion of the neck to at least a portion of an underside of the desk support;

a weight secured to the desk support base, sized and weighted to, at least in part, offset the weight of the neck and desk support surface; and a seat comprising:

a seat core secured to the desk support base; and a textured cover positioned over the seat core.

2. The system of claim 1, wherein the desk support surface is unitarily formed with the neck.

3. The system of claim 1, wherein the neck is unitarily formed with the desk support base.

4. The system of claim 1, wherein the desk support surface further comprises a hand rest portion, angled downwardly from the desk support surface at a position where a user could rest a hand during use of the system.

5. The system of claim 1 wherein at least two indented portions are formed into opposing sides of the neck, sized to facilitate gripping by a human hand.

* * * * *